US008505723B2

(12) United States Patent
Clark et al.

(10) Patent No.: US 8,505,723 B2
(45) Date of Patent: Aug. 13, 2013

(54) PACKAGING SYSTEM FOR RETAINING PROPULSIVE DEVICES

(75) Inventors: Marcus T. Clark, Kaysville, UT (US); Patti Quinney, Layton, UT (US); Nyle K. Longhurst, Layton, UT (US)

(73) Assignee: Autoliv Asp, Inc., Ogden, UT (US)

( * ) Notice: Subject to any disclaimer, the term of this patent is extended or adjusted under 35 U.S.C. 154(b) by 448 days.

(21) Appl. No.: 12/792,127

(22) Filed: Jun. 2, 2010

(65) Prior Publication Data

US 2011/0296800 A1 Dec. 8, 2011

(51) Int. Cl.

| | |
|---|---|
| ***B65D 85/20*** | (2006.01) |
| ***B65D 1/34*** | (2006.01) |
| ***A47F 1/04*** | (2006.01) |

(52) U.S. Cl.

USPC ..... 206/443; 206/446; 206/562; 206/565; 211/60.1

(58) Field of Classification Search

USPC ..... 206/443, 446, 562–564, 565; 211/69.1, 211/69.3, 74, 60.1, 69

See application file for complete search history.

(56) References Cited

U.S. PATENT DOCUMENTS

| | | | | | |
|---|---|---|---|---|---|
| 1,569,506 | A * | 1/1926 | Law | 206/443 |
| 3,165,200 | A * | 1/1965 | Hanson | 206/562 |
| 3,591,014 | A * | 7/1971 | Lindgren et al. | 206/564 |
| 4,681,219 | A * | 7/1987 | Kitchens | 206/562 |
| 4,773,544 | A * | 9/1988 | McCarthy | 206/443 |
| 5,012,923 | A * | 5/1991 | Hayes | 206/443 |
| 5,080,232 | A * | 1/1992 | Leoncavallo et al. | 206/443 |
| 5,396,989 | A * | 3/1995 | Hein | 206/443 |
| 6,719,141 | B2 * | 4/2004 | Heinz et al. | 206/563 |
| 7,152,736 | B1 * | 12/2006 | Menichini | 206/443 |

FOREIGN PATENT DOCUMENTS

EP 539689 A1 * 5/1993

* cited by examiner

*Primary Examiner* — Bryon Gehman
(74) *Attorney, Agent, or Firm* — Harness, Dickey & Pierce, P.L.C.

(57) ABSTRACT

A packaging fixture may include a first member including a plurality of first generally round apertures and a plurality of first elongated apertures. The first member may include a thickness from a first side to an opposite second side and each of the plurality of first round apertures and the plurality of elongated apertures may extend through the thickness of the first member. Each of the plurality of elongated apertures may be connected to and extend from a corresponding one of the plurality of first round apertures. Each of the plurality of first round apertures may be adapted to receive a portion of a propulsive device. The first member may be adapted to retain the propulsive device when a protrusion of the propulsive device is misaligned with a corresponding one of the plurality of elongated apertures.

22 Claims, 6 Drawing Sheets

PACKAGING SYSTEM FOR RETAINING PROPULSIVE DEVICES

FIELD

The present disclosure relates to a packaging system, and more particularly to a packaging system for retaining propulsive devices.

BACKGROUND

This section provides background information related to the present disclosure which is not necessarily prior art.

Many modern automotive vehicles include one or more airbags that inflate to protect an occupant of the vehicle during a crash or impact event. The airbag system may include a propulsion device or inflator that rapidly releases high-pressure gas or other fluid into the airbag to nearly instantaneously inflate the airbag in response to a sensed impact event.

Such inflators are often manufactured at a facility that is remote from a facility in which the airbag system or the vehicle are assembled. Therefore, the inflators are often shipped in bulk via truck, airplane, train, and/or boat to the facility in which the inflators will be integrated into vehicles and/or airbag assemblies. Before and/or after being shipped, the inflators may also be stored in inventory at a plant or warehouse, for example, before they are installed into airbag assemblies.

The present disclosure provides a packaging apparatus and method for packaging one or more inflators for shipment and/or storage.

SUMMARY

This section provides a general summary of the disclosure, and is not a comprehensive disclosure of its full scope or all of its features.

In one form, the present disclosure provides a packaging fixture that may include a first member including a plurality of first generally round apertures and a plurality of first elongated apertures. The first member may include a thickness from a first side to an opposite second side and each of the plurality of elongated apertures may be connected to and extend from a corresponding one of the plurality of first round apertures. The plurality of first round apertures and the plurality of elongated apertures may each extend through the thickness of the first member. Each of the plurality of first round apertures may be adapted to receive a portion of a propulsive device. The first member may be adapted to retain the propulsive device when a protrusion of the propulsive device is misaligned with a corresponding one of the plurality of elongated apertures.

In another form, the present disclosure provides a packaging system that may include a first member and a clocking member. The first member may include a first side, a second opposite side and a plurality of first apertures extending therethrough. Each of the plurality of first apertures may include a substantially round portion and an elongated portion extending outward from the round portion. The clocking member may include a first surface, a second opposite surface and a plurality of second apertures having locating portions and clocking portions. Each of the plurality of second apertures may correspond to one of the plurality of first apertures. The locating portions may be aligned with the round portions of the plurality of first apertures. Each of the clocking portions may include a helically inclined surface having a first end and a second end. The first end may be aligned with a corresponding one of the elongated portions of the plurality of first apertures. The first surface of the second member may be positioned adjacent the second side of the first member.

In yet another form, the present disclosure provides a method that may include providing a propulsion device having a body and first and second protrusions extending therefrom, and providing a restraining member having an aperture including a substantially round portion and an elongated portion extending therefrom. A portion of the body may be inserted through the round portion. The first protrusion may be inserted through the elongated portion. The propulsion device may be rotated about its longitudinal axis such that the first and second protrusions are rotationally misaligned with the elongated portion and the first and second protrusions are disposed on opposite sides of the restraining member.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

DETAILED DESCRIPTION

Figure 1:
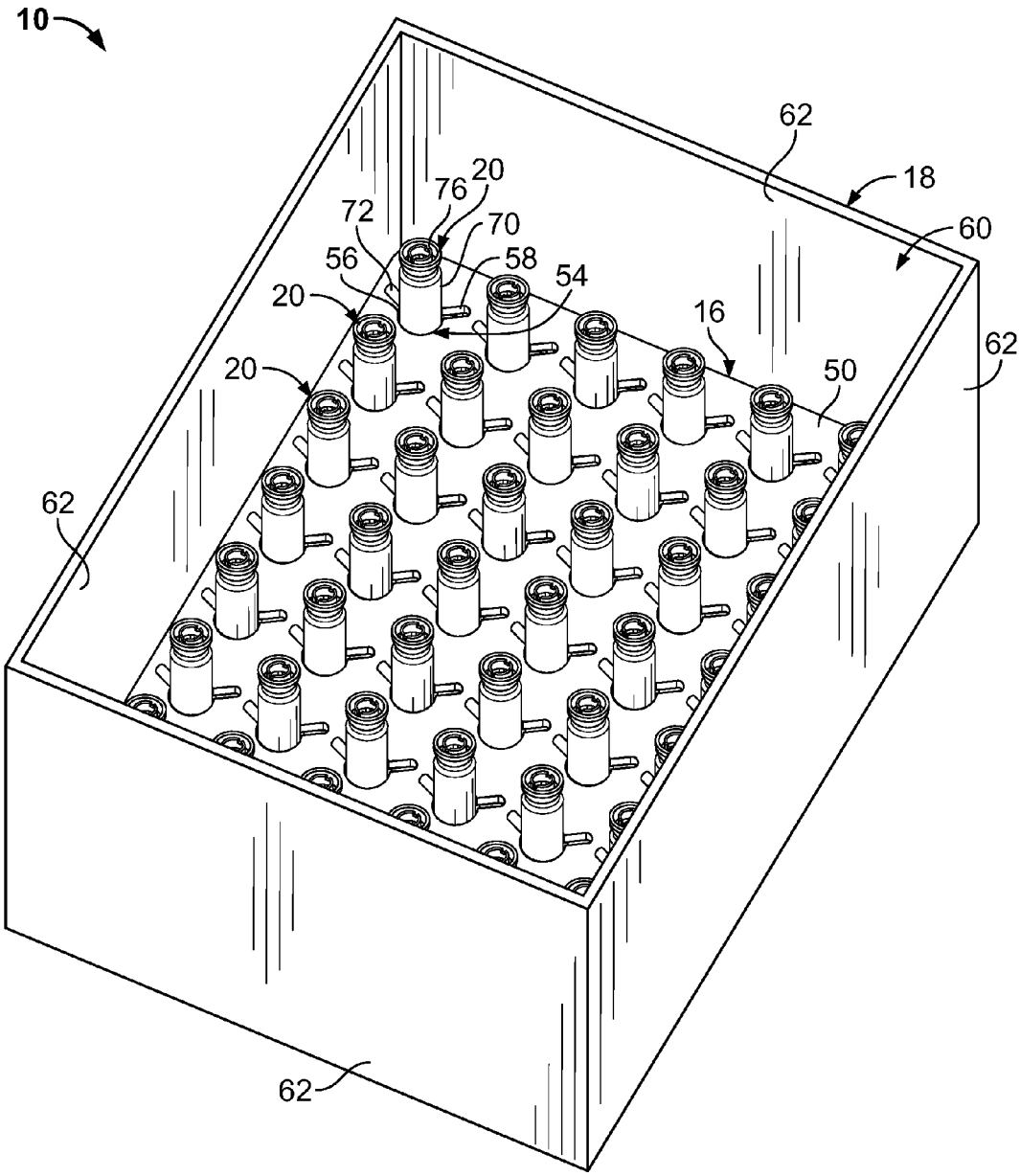
FIG. 1 is a perspective view of a packaging system according to the principles of the present disclosure, the packaging system shown operatively associated with a plurality of propulsive devices.
Figure 2:
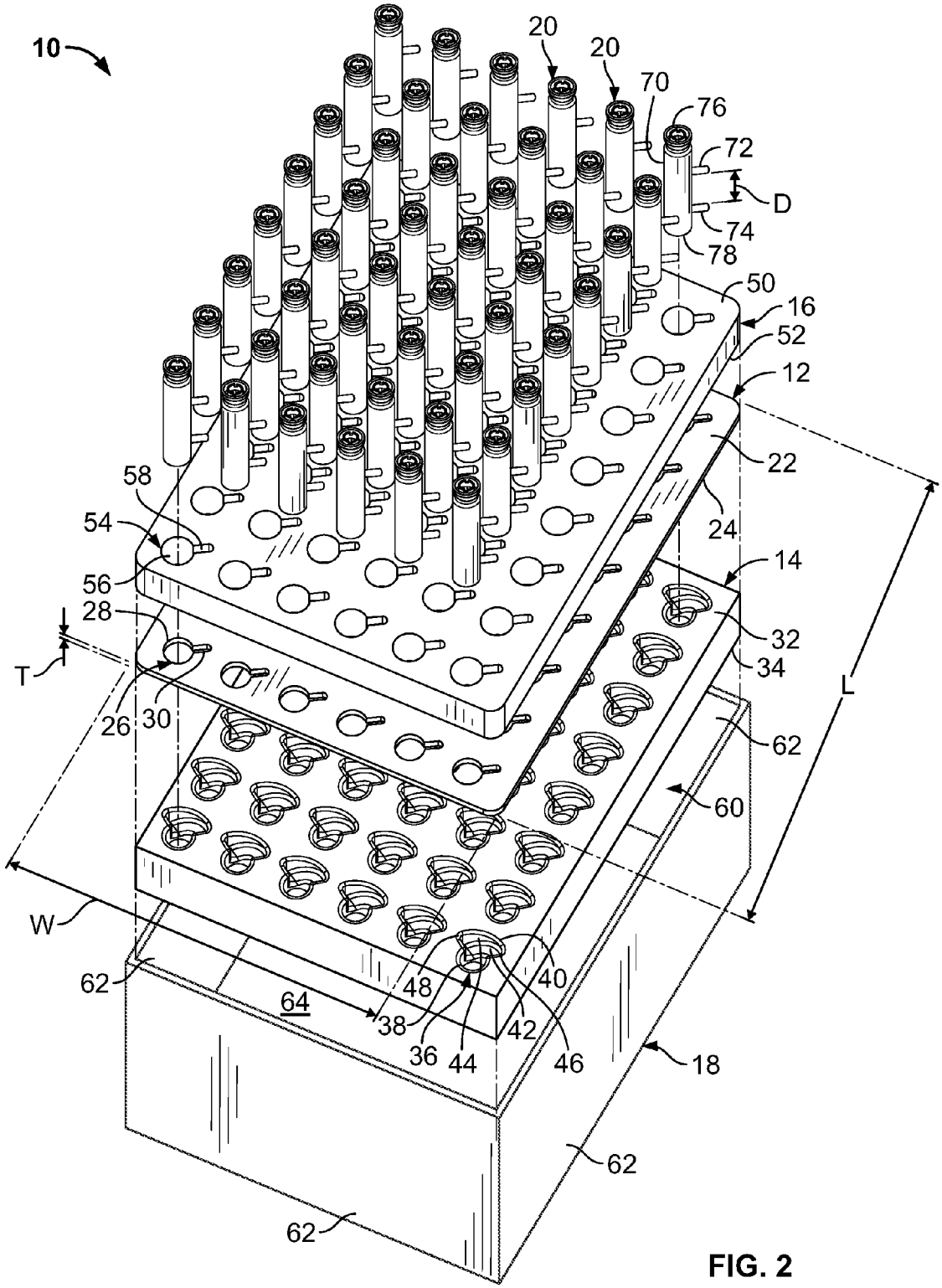
FIG. 2 is an exploded perspective view of the packaging system of FIG. 1.
Figure 3:
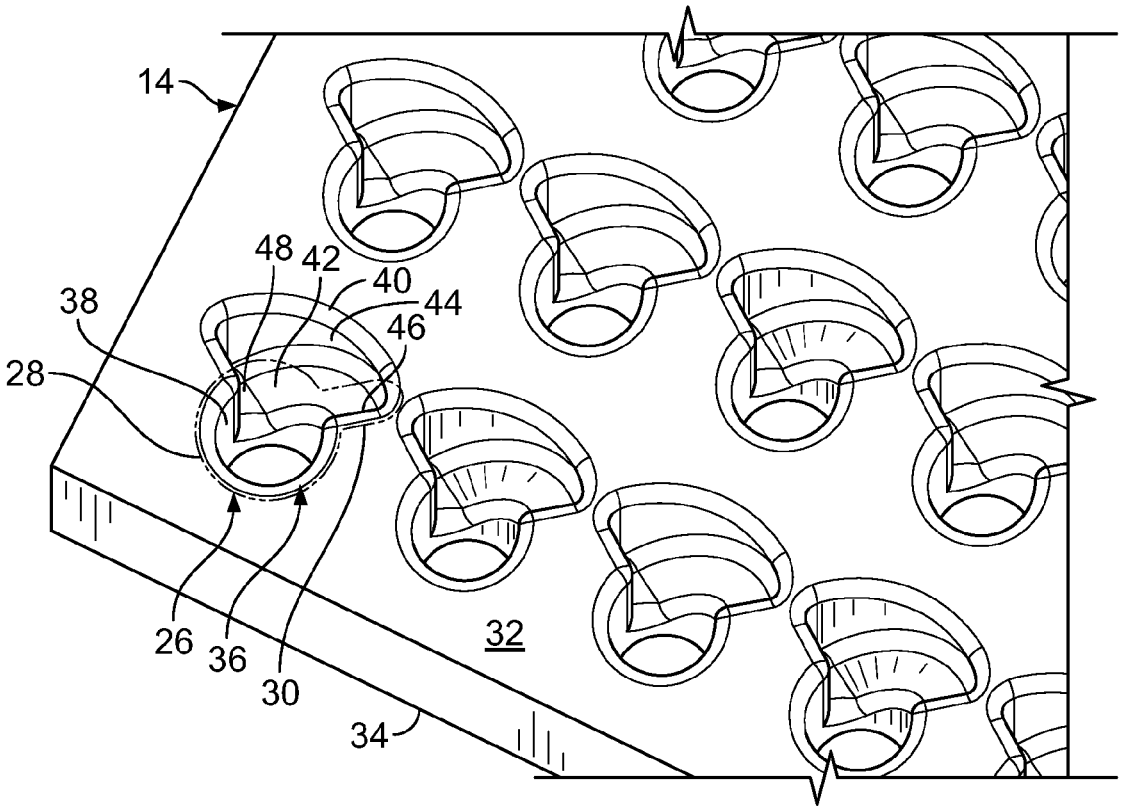
FIG. 3 is a partial perspective view of a clocking member according to the principles of the present disclosure.

The following description is merely exemplary in nature and is not intended to limit the present disclosure, its application, or uses. It should be understood that throughout the several views of the drawings, corresponding reference numerals indicate like or corresponding parts and features, with the various elements within each view being drawn to scale.

Throughout the description, example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail.

The terminology used herein is for the purpose of describing particular example embodiments only and is not intended to be limiting. As used herein, the singular forms "a," "an," and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

When an element or layer is referred to as being "on," "engaged to," "connected to," or "coupled to" another element or layer, it may be directly on, engaged, connected or coupled to the other element or layer, or intervening elements or layers may be present. In contrast, when an element is referred to as being "directly on," "directly engaged to," "directly connected to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Spatially relative terms, such as "inner," "outer," "beneath," "below," "lower," "above," "upper," and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

With reference to FIGS. 1-6, a packaging assembly 10 is provided and may include a retaining member 12, a clocking member 14, an upper insert 16, and a container 18. As will be subsequently described, the packaging assembly 10 may be a fixture receiving and retaining one or more propulsion devices or inflators 20 for storage in a plant or warehouse and/or shipment via truck, airplane, train and/or boat, for example.

The retaining member 12 may be a generally flat member including a first side 22, a second opposite side 24, and a plurality of apertures 26 extending through the first side 22 and the second side 24. The retaining member 12 may be formed from a metallic material such as, for example, aluminum, steel, iron or other metal. Alternatively, the retaining member 12 may be formed from a heat-resistant polymeric or composite material. The first and second sides 22, 24 may be defined by a length L and a width W of the retaining member 12. A thickness T of the retaining member 12 may be substantially smaller than the length L and width W. For example, the length L may be approximately twenty-one inches (533.4 millimeters), the width W may be approximately fourteen inches (355.6 millimeters), and the thickness T may be approximately 0.03 inches (0.76 millimeters). It will be appreciated that the width W, length L, and thickness T could be any dimensions and could be sized differently relative to each other.

Each of the plurality of apertures 26 may include a substantially round portion 28 and an elongated portion 30 extending outwardly from the round portion 28 forming a continuous aperture. The plurality of apertures 26 may be spaced apart from each other and may be arranged in a rectangular or circular array, for example. In an exemplary embodiment illustrated in FIG. 2, the plurality of apertures 26 are arranged in a six-by-eight rectangular array. The elongated portions 30 of the plurality of apertures 26 may be oriented in the same direction relative to the length L and width W of the retaining member 12.

The clocking member 14 may be a generally flat member formed from a metallic, polymeric, cardboard, or wood material, for example. In some embodiments, the clocking member 14 may be formed from a resiliently compliant foam or other soft polymeric material. The clocking member 14 may include a first side 32, a second opposite side 34, and a plurality of apertures 36 extending through the first and second sides 32, 34. The first side 32 may be disposed adjacent to the second side 24 of the retaining member 12. The clocking member 14 may include an equal number of apertures 36 as a number of apertures 26 in the retaining member 12. The apertures 36 may be arranged and spaced apart from each other in a manner corresponding to the arrangement and spacing of the apertures 26. Each of the plurality of apertures 36 may correspond to one of the plurality of apertures 26 of the retaining member 12.

Each of the plurality of apertures 36 may include a substantially round locating portion 38 and a clocking portion 40 extending outwardly from the locating portion 38. The locating portion 38 of each of the plurality of apertures 36 may be substantially aligned with the round portion 28 of a corresponding one of the plurality of apertures 26 of the retaining member 12, such that longitudinal axes defining the locating portion 38 and the corresponding round portion 28 may be substantially collinear. The locating portion 38 may extend through the first and second sides 32, 34, as shown in the figures. However, in other embodiments, the locating portion 38 may extend through the first side 32 and only partially through a depth or thickness of the clocking member 14.

The clocking portion 40 may be a cutout extending radially outward from the locating portion 38 and may include a helically inclined surface 42 and a curved outer perimeter or surface 44. The inclined surface 42 may include a first end 46 and a second end 48. The first end 46 may be disposed at or below the first side 32 of the clocking member 14. The first end 46 may be substantially aligned with the elongated portion 30 of a corresponding aperture 26 in the retaining member 12. The inclined surface 42 may extend from the first end 46 helically downward (relative to the views shown in FIGS. 1-6) and around a portion of the circumference of the locating portion 38 to the second end 48. The second end 48 may be angularly spaced apart from the first end 46 by about 90 to 180 degrees and may be spaced a greater distance from the first side 32 than the first end 46.

The upper insert 16 may be a generally flat member including an upper surface 50, a lower surface 52, and a plurality of apertures 54. The upper insert 16 may be formed from a metallic, polymeric, cardboard, or wood material, for example. In some embodiments, the upper insert 16 may be formed from a resiliently compliant foam or other soft polymeric material. The lower surface 52 of the upper insert 16 may abut the first side 22 of the retaining member 12. The upper insert 16 may include an equal number of apertures 54 as a number of apertures 26 in the retaining member 12. The apertures 54 may be arranged and spaced apart from each other in a manner corresponding to the arrangement and spacing of the apertures 26. Each of the plurality of apertures 54 may include a round portion 56 and an elongated portion 58. The round portion 56 and elongated portion 58 of each of the apertures 54 may be aligned with the round portion 28 and elongated portion 30, respectively, of a corresponding one of the apertures 26 of the retaining member 12.

The container 18 may be a cardboard box, or a metallic, wooden or polymeric crate, bin or enclosure, for example, or any other container. The container 18 may include an opening 60 defined by a plurality of sides 62 and a bottom 64. The container 18 may receive the retaining member 12, the clocking member 14, the upper insert 16, and the propulsion devices 20 such that the second side 34 of the clocking member 14 rests on the bottom 64 of the container 18. While not specifically shown in the figures, the container 18 may include a lid or top portion that may be placed over the opening 60 to enclose the retaining member 12, the clocking member 14, the upper insert 16, and the propulsion devices 20 inside of the container 18. The container 18 may be stackable to facilitate loading a plurality of containers 18 onto pallets and/or into a cargo area of a vehicle for shipping.

The propulsion devices 20 may be inflators for a vehicle airbag system, or other devices containing pressurized fluid and/or pyrotechnic media, and may include a body portion 70, a first attachment member or stud 72, and a second attachment member or stud 74. The body portion 70 may include a first end 76 and a second end 78. The propulsion device 20 may be operable to discharge a pressurized gas or other fluid through the first end 76. The first and second studs 72, 74 may be generally straight protrusions extending radially outwardly from the body portion 70. The first and second studs 72, 74 may be substantially angularly aligned with each other and spaced apart from each other along a length of the body portion 70 by a distance D.

The round portions 28 of the apertures 26 of the retaining member 12, the locating portions 38 of the apertures 36 of the clocking member 14, and the round portions 56 of the apertures 54 of the upper insert 16 may be sized relative to a diameter of the body portion 70 such that the body portion 70 may be received in the round portions 28, 56 and locating portion 38. The elongated portions 30 of the apertures 26 of the retaining member 12 and the elongated portions 58 of the apertures 54 of the upper insert 16 are sized relative to the second stud 74 such that the second stud 74 may be inserted through the elongated portions 30, 58. A radial distance between the locating portion 38 of the apertures 36 of the clocking member 14 and the outer surface 44 of the clocking portion 40 of the apertures 36 may be sized relative to the second stud 74 such that the second stud 74 may engage the helically inclined surface 42 and slide thereon between the first end 46 and the second end 48 of the inclined surface 42. In some exemplary embodiments, the apertures 26 of the retaining member 12 may be sized slightly larger than the apertures 36, 54 of the clocking member 14 and upper insert 16, respectively. In this manner, the polymeric material of the clocking member 14 and/or upper insert 16 may protect the propulsion devices 20 from being scratched by the metal edges of the retaining member 12 during installation of the propulsion devices 20 into the packaging assembly 10.

When the propulsion devices 20 are in a fully installed position within the packaging assembly 10 (FIGS. 1 and 6), a distance between the inclined surface 42 at the second end 48 and the upper surface 50 of the upper insert 16 may be substantially equal to the distance D between the first and second studs 72, 74. In this manner, the first stud 72 may be in contact with the upper surface 50 and the second stud 74 may be in contact with the second end 48 when the propulsion device 20 is in the fully installed position. In the fully installed position, the first and second studs 72, 74 may be angularly misaligned relative to the elongated portions 30, 58 of the apertures 26, 54, respectively.

With continued reference to FIGS. 1-6, operation and functionality of the packaging assembly 10 as well as a method of packaging the propulsion devices 20 will be described in greater detail. One or more propulsion devices 20 may be installed in the packaging assembly 10 to arrange and protect the propulsion devices 20 during shipping and/or storage. As will be subsequently described, the packaging assembly 10 may also restrain the propulsion devices 20 in the event that the pressurized gas in the body portions 70 of the propulsion devices 20 inadvertently escapes therefrom during shipment or storage. For example, if a fire or well-placed impact were to cause one or more of the propulsion devices 20 to release the pressurized gases during shipping or storage, the retaining member 12 and/or the other components of the packaging assembly 10 may be operable to prevent one or more of the propulsion devices 20 from being ejected or propelled out of the packaging assembly 10 from the thrust of the pressurized gas.

As described above, the clocking member 14, retaining member 12, and the upper insert 16 may be inserted into the opening 60 of the container 18. The second side 34 of the clocking member 14 may be adjacent to the bottom 64 of the container 18. The second side 24 of the retaining member 12 may be adjacent to the first side 32 of the clocking member 14. The lower surface 52 of the upper insert 16 may be adjacent to the first side 22 of the retaining member 12.

Figure 4:
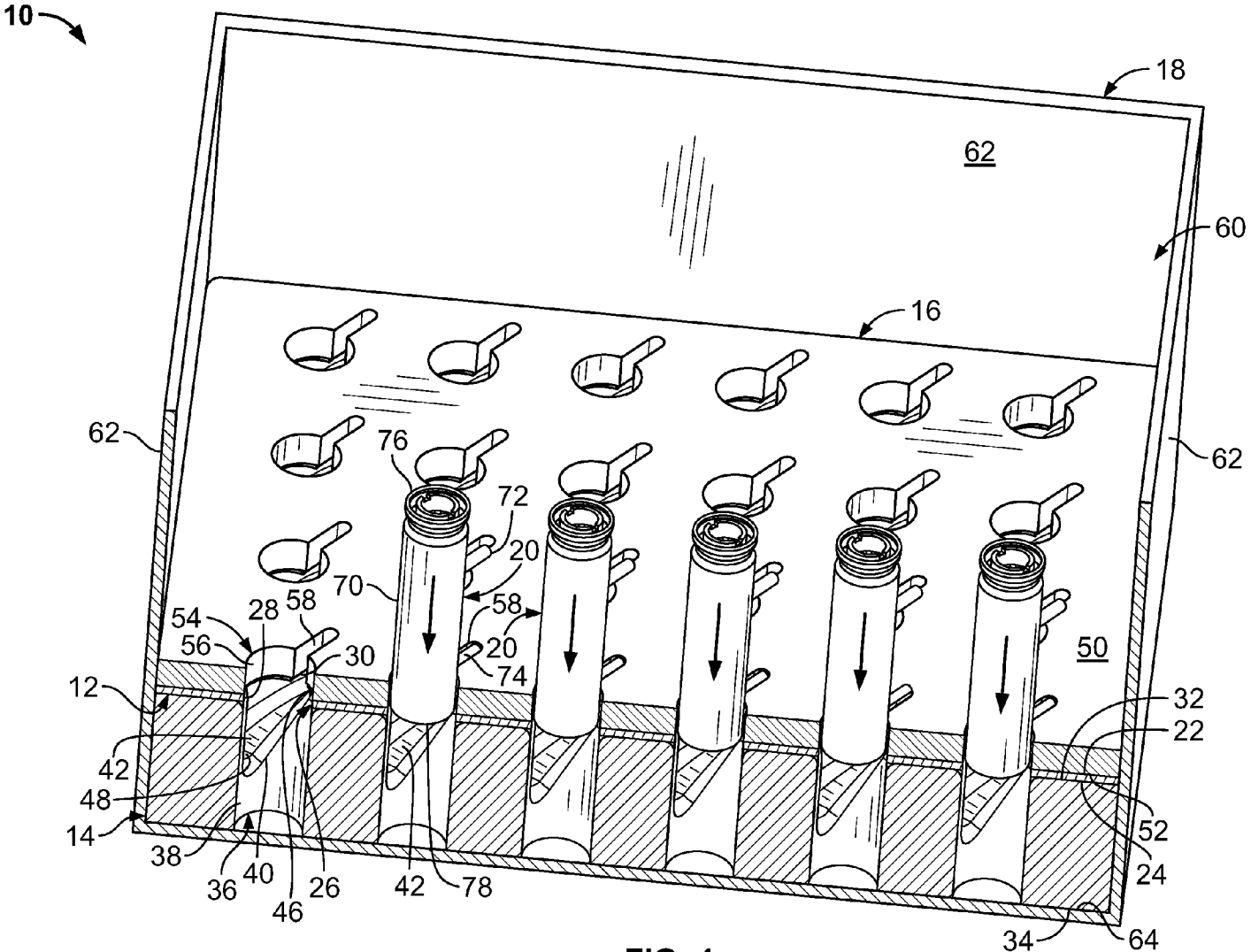
FIG. 4 is a cross-sectional perspective view of propulsive devices being installed into the packaging system according the principles of the present disclosure.

As shown in FIG. 4, with the second stud 74 of the propulsion device 20 aligned with the elongated portions 30, 58 of the apertures 26, 54 of the retaining member 12 and upper insert 16, respectively, the second end 78 of the propulsion device 20 may be inserted through the round portions 28, 56 of the apertures 26, 54 of the retaining member 12 and upper insert 16, respectively. The body portion 70 of the propulsion device 20 may be slid in a downward direction (relative to the view shown in FIG. 4) through the round portions 28, 56 of the apertures 26, 54 until the second stud 74 contacts the first end 46 of the inclined surface 42 of the clocking member 14.

Figure 5:
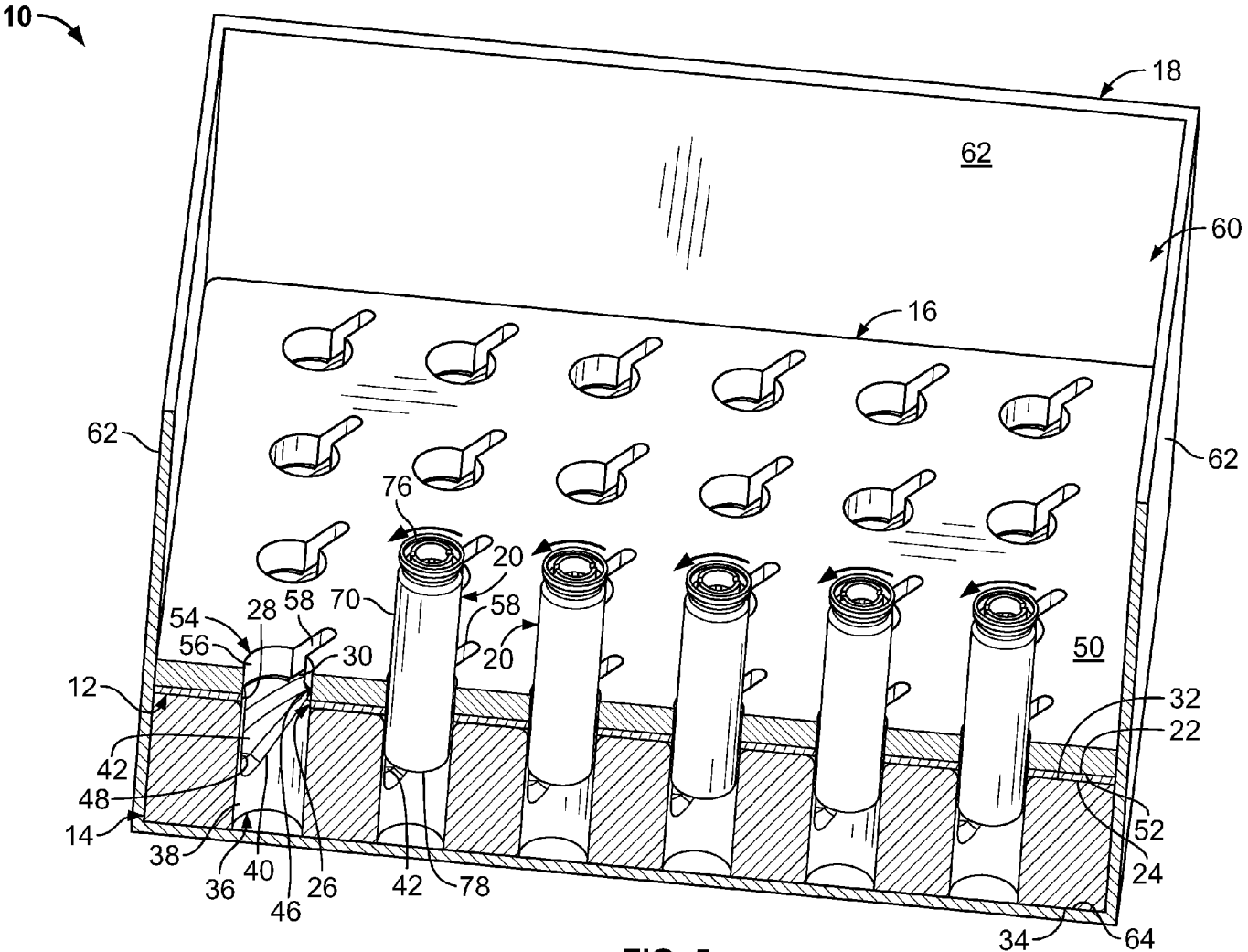
FIG. 5 is another cross-sectional perspective view of the propulsive devices being installed into the packaging system according the principles of the present disclosure.
Figure 6:
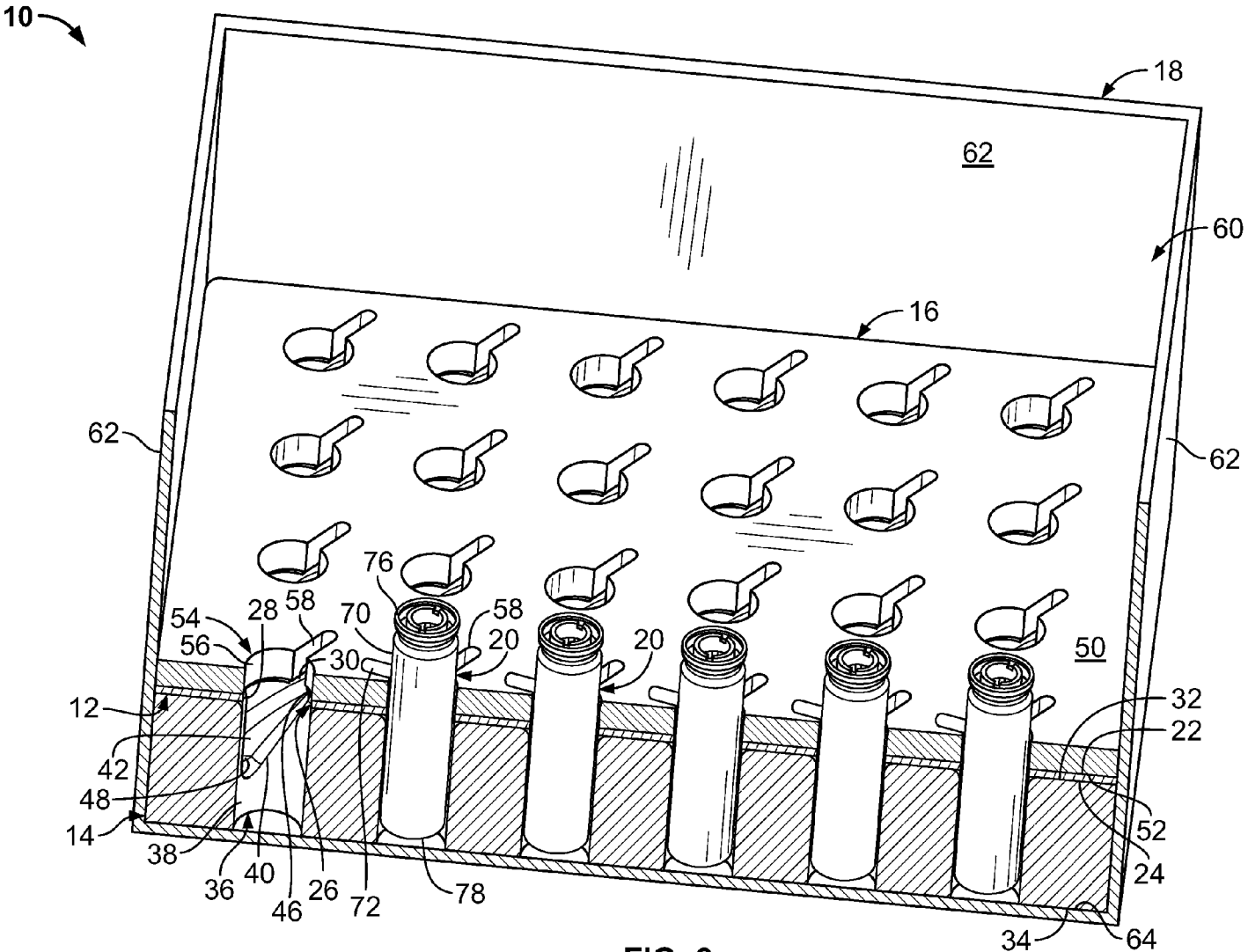
FIG. 6 is a cross-sectional perspective view of the propulsive devices in an installed position in the packaging system according the principles of the present disclosure.

As generally shown in FIG. 5, once the second stud 74 is in contact with the first end 46 of the inclined surface 42, the propulsion device 20 may be rotated about a longitudinal axis of the body portion 70 such that the second stud 74 may slide about the inclined surface 42 in a downward helical motion toward the second end 48 of the inclined surface 42. In this manner, inclined surface 42 may facilitate the rotation of propulsive device 20 as it is inserted into apertures 26, 54.

In the fully installed position (FIG. 6), the second stud 74 may be disposed at the second end 48 of the inclined surface and the first stud 72 may be proximate to or in contact with the upper surface 50 of the upper insert 16. In the fully installed position, the first and second studs 72, 74 may be angularly misaligned with the elongated portions 30, 58 of the apertures 26, 54 of the retaining member 12 and upper insert 16, respectively. In this manner, if a fire or impact were to cause the inadvertent discharge of the pressurized gas within one or more of the propulsion devices 20, the retaining member 12 and upper insert 16, being disposed between the first and second studs 72, 74, would restrain the propulsion devices 20 and prevent the thrust from the pressurized gas of the one or more propulsion devices 20 from propelling the propulsion device 20 and/or adjacent propulsion devices 20 out of the packaging assembly 10.

The propulsion devices 20 can be removed from the packaging assembly 10 by performing the reverse of the operations described above for installing the propulsion devices 20. That is, the propulsion device 20 may be rotated in a direction opposite that shown in FIG. 5, such that the second stud 74 may slide along the inclined surface 42 from the second end 48 toward the first end 46 thereof. Then, the body portion 70 of the propulsion device 20 can be slid upward through the round portions 28, 56 of the apertures 26, 54.

While the method of installing the propulsion device 20 into the packaging assembly 10 is described above as including the step of inserting the second end 78 of the propulsion device 20 into the locating portion 38 of the aperture 36 and the round portions 28, 56 of the apertures 26, 54, in some exemplary embodiments, the orientation of the first and second ends 76, 78 relative to the packaging assembly 10 may be reversed. That is, the first end 76 may be inserted into the locating portion 38 of the aperture 36 and the round portions 28, 56 of the apertures 26, 54, and the first stud 72 may engage the clocking portion 40 of the aperture 36.

As described above, the retaining member 12 can be formed from a metallic or other heat resistant material, and the clocking member 14 and/or upper insert 16 can be formed from a resiliently compliant material, such as foam, for example. In such embodiments, if the packaging assembly 10 is exposed to a fire during transit or storage, the structural integrity of the heat-resistant retaining member 12 may remain intact beyond a duration over which the propulsion devices 20 can retain their propulsive media. Therefore, even after the clocking member 14, upper insert 16, and/or container 18 may burn away, the retaining member 12 will still be operable to retain the propulsion devices 20. The resiliently compliant or other polymeric material of the clocking member 14 and/or the upper insert 16 may protect the propulsion devices 20 from impacts, vibrations, and/or scratches during installation of the propulsion devices 20 into the packaging assembly 10, during transit of the propulsion devices 20 in the packaging assembly 10, and/or during removal of the propulsion devices 20 from the packaging assembly 10.

While the packaging assembly 10 is described above as including the retaining member 12, the clocking member 14, the upper insert 16, and the container 18, in some embodiments, the propulsion devices 20 may be shipped and/or stored in the packaging assembly 10 without one or more of these components. Additional layers, members, and/or protective materials may be added to the packaging assembly 10 in addition to or instead of one or more of the components described above. While the packaging assembly 10 is described above as accommodating a plurality of propulsion devices 20, in some embodiments, the packaging assembly 10 may be configured to accommodate only a single propulsion device 20. Furthermore, it will be appreciated that the packaging assembly 10 is not limited in application to packaging the propulsion devices 20 or other pyrotechnic devices. Other sorts of products and devices may be installed in the packaging assembly 10 for shipment and/or storage.

The foregoing description of the embodiments has been provided for purposes of illustration and description. It is not intended to be exhaustive or to limit the invention. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the invention, and all such modifications are intended to be included within the scope of the invention.

What is claimed is:

1. A packaging fixture comprising:

a first member including a plurality of first generally round apertures, a plurality of first elongated apertures, and a thickness from a first side to an opposite second side, each of said plurality of elongated apertures being connected to and extending from a corresponding one of said plurality of first round apertures, said plurality of first round apertures and said plurality of elongated apertures each extending through said thickness; and a second member including a plurality of second generally round apertures and a plurality of helically inclined cutouts, each of said plurality of helically inclined cutouts being disposed at least partially around a corresponding one of said second round apertures and having a first end aligned with a corresponding one of said elongated apertures, said second member engaging said second side of said first member;

wherein each of said plurality of first round apertures is adapted to receive a portion of a propulsive device, and said first member is adapted to retain the propulsive device when a protrusion of the propulsive device is misaligned with a corresponding one of said plurality of elongated apertures.

2. The packaging fixture of claim 1, wherein said second member includes a first surface and a second opposite surface and said helically inclined cutouts include a second end angularly spaced at least 90 degrees apart from said first end such that said helically inclined cutouts extend at an acute angle relative to said first surface from said first end adjacent said first surface towards said second surface to said second end.

3. The packaging fixture of claim 1, wherein said first member is formed from a metallic material and said second member is formed from a polymeric material, and wherein said second member has a thickness substantially greater than the thickness of said first member, said first member being generally flat and having a length and width substantially greater than its thickness.

4. The packaging fixture of claim 1, wherein said second member is a generally flat second member having an upper side and an opposite lower side.

5. The packaging fixture of claim 4, wherein said generally flat second member is formed from at least one of a cardboard material and a resiliently compressible material.

6. The packaging fixture of claim 1, further comprising a container receiving said first member.

7. A packaging system comprising:

a first member including a first side, a second opposite side and a plurality of first apertures extending therethrough, each of said plurality of first apertures including a substantially round portion and an elongated portion extending outward from said round portion; and a clocking member including a first surface, a second opposite surface and a plurality of second apertures having locating portions and clocking portions, said locating portions being aligned with said round portions of said plurality of first apertures, each of said clocking portions including a helically inclined surface having a first end and a second end, said first end being aligned with a corresponding one of said elongated portions of said plurality of first apertures, and said first surface of said clocking member being positioned adjacent said second side of said first member.

8. The packaging system of claim 7, wherein said helically inclined surfaces extend angularly about corresponding longitudinal axes of said round portions.

9. The packaging system of claim 8, wherein said helically inclined surfaces extend angularly at least 90 degrees between said first end and said second end, said second end being spaced a greater distance from said first surface than said first end.

10. The packaging system of claim 7, wherein said first member is formed from at least one of a metallic material and a polymeric material.

11. The packaging system of claim 10, wherein said first member includes a thickness of about 0.03 inches.

12. The packaging system of claim 7, further comprising a container receiving said first member and said clocking member therein.

13. The packaging system of claim 7, further comprising an insert member having an upper surface and an opposite lower surface, said lower surface being adjacent to said first side of said first member opposite said clocking member.

14. The packaging system of claim 13, wherein said insert member includes a plurality of third apertures having round portions and elongated portions extending therefrom, said round portions of said third apertures aligning with corresponding round portions of said first apertures, said elongated portions of said third apertures aligning with corresponding elongated portions of said first apertures.

15. The packaging system of claim 13, wherein said insert member is formed from at least one of a cardboard material and a resiliently compressible polymeric material.

16. The packaging system of claim 13, further comprising a container receiving said first member, said clocking member, and said insert member therein.

17. The packaging system of claim 13, further comprising a propulsion device having a body portion and a first and a second protrusion extending therefrom, said body portion engaging said locating portion of one of said second apertures, said first protrusion engaging said helically inclined surface of said second aperture, said second protrusion contacting said upper surface of said insert member.

18. The packaging system of claim 17, wherein said first protrusion engages said second end of said helically inclined surface when said second protrusion engages said upper surface of said insert member.

19. The packaging system of claim 7, further comprising a propulsion device having a body portion and first and second protrusions extending therefrom, said body portion engaging said locating portion of one of said second apertures, said first protrusion engaging said helically inclined surface of said clocking portion of said second aperture.

20. The packaging system of claim 7 in combination with at least one propulsion device, each propulsion device received within a respective one of the first round apertures.

21. The packaging system in combination with at least one propulsion device of claim 20, wherein each propulsion device includes first and second protrusions, each propulsion device rotated about its longitudinal axis such that said first and second protrusions are rotationally misaligned with said elongated portion and said first and second protrusions are disposed on opposite sides of said first member.

22. A packaging fixture for retaining at least one propulsion device each propulsion device having a main body portion and a protrusion extending from the main body portion, the packaging fixture comprising:

a first member including a plurality of first openings extending therethrough, each of said plurality of first openings having a main portion for receiving the main body portion of a propulsion device and a dependent portion extending from the main portion and configured to allow the protrusion to pass through the first member; and a second member including a plurality of second openings extending at least partially therethrough, each second opening includes an inclined portion for engaging the protrusion of the propulsion device aligned with a corresponding one of said dependent portions of the first openings;

wherein said second member is adapted to rotate the main body portion of the propulsion device so as to misalign the protrusion relative to the dependent portion of the first opening and said first member is adapted to retain the propulsive device when the protrusion of the propulsive device is misaligned with the dependent portion.

* * * * *